United States Patent [19]

Molyneux

[11] 4,237,665

[45] Dec. 9, 1980

[54] STRUCTURAL ELEMENTS FOR BUILDING CONSTRUCTION AND ASSEMBLIES INCORPORATING THESE ELEMENTS

[75] Inventor: George Molyneux, Plymouth, England

[73] Assignee: Radway Plastics Limited, Solihull, England

[21] Appl. No.: 879,566

[22] Filed: Feb. 21, 1978

[51] Int. Cl.[3] ..... E06B 1/60

[52] U.S. Cl. ..... 52/213; 49/485; 49/504; 52/204; 52/730

[58] Field of Search ..... 52/714, 61, 62, 208, 52/204, 213, 730, 720; 49/504, 485

[56] References Cited

U.S. PATENT DOCUMENTS

| | | | |
|---|---|---|---|
| 3,057,444 | 10/1962 | Walberg | 52/235 |
| 3,486,288 | 12/1969 | Pyne | 52/738 |
| 3,707,815 | 1/1973 | Molyneax | 52/213 |
| 3,711,995 | 1/1973 | Anderson | 49/504 |
| 4,084,361 | 4/1979 | Aspans | 49/504 |

FOREIGN PATENT DOCUMENTS

| | | | |
|---|---|---|---|
| 1208335 | 2/1960 | France | 52/235 |
| 1331132 | 5/1963 | France | 52/213 |
| 329652 | 6/1958 | Switzerland | 49/485 |
| 356585 | 10/1961 | Switzerland | 49/485 |

*Primary Examiner*—James A. Leppink
*Assistant Examiner*—Henry E. Raduazo
*Attorney, Agent, or Firm*—John C. Smith, Jr.

[57] ABSTRACT

The invention provides a structural assembly for use in a building comprising a sub-frame structural element and a metal window frame element; said sub-frame element itself comprising a strip of corrosion-resistant liquid-impermeable material (e.g. unplasticised polyvinylchloride) of substantially constant cross-section throughout its length, said cross-section providing a substantially rectangular overall shape, providing the strip with two side faces and two edge faces, at least two parallel longitudinally extending grooves in one side face of said strip; and intermediate "land" on said one side face between each adjacent pair of said at least two grooves; two outer "lands" located respectively between each laterally outer groove of said at least two grooves and the adjacent edge face of said strip, said two outer "lands" being of unequal width; said window frame element having a longitudinally extending web, and said sub-frame element and said window frame element being secured to each other with the web supported by at least one of said "lands", there being at least one of said grooves located under said web.

The groove or grooves located under the web of the window frame element provides a moisture barrier and any groove on the inside of the said web provides a condensation trough. In a preferred form, the sub-frame element is also grooved on the opposite side, and means are provided for securing the sub-frame element to the wall.

10 Claims, 32 Drawing Figures

STRUCTURAL ELEMENTS FOR BUILDING CONSTRUCTION AND ASSEMBLIES INCORPORATING THESE ELEMENTS

The present invention is concerned with the manufacture and fitting of sub-frames, as used in building construction, within openings formed in the walls of the building, to receive the frames of windows and doors. Metal door and window frames are now frequently used in building construction, but if a metal frame is fitted directly against the conventional wall building materials (i.e. cement, plaster, lime and the like) the acidic or alkaline nature of the building material has a detrimental effect on the metal frame. In particular, an aluminium frame deteriorates quickly under acid or alkaline attack. Since it is almost impossible to provide a damp-course between the building materials and the metal frame, it is usual to employ a sub-frame surrounding the metal frame.

Traditionally, sub-frames have been manufactured of timber, but owing to the high cost of timber sub-frames, the overall cost of the metal frame window can become prohibitive. In recent years, attention has been directed to the manufacture of sub-frames in plastics material, particularly extruded unplasticised polyvinylchloride (u.p.v.c.) since a sub-frame can be relatively inexpensive, and automatically provides a damp-course between the building materials and the metal window frame.

However, problems are encountered in the manufacture of a successful extruded plastics sub-frame element, and a primary objective of the present invention is to overcome at least some of these difficulties.

According to one aspect of this invention, a sub-frame structural element comprises a strip of corrosion-resistant liquid-impermeable material having a cross-section which is substantially constant throughout its length and of rectangular overall shape, providing the strip with side faces and edge faces, at least two parallel grooves being formed in one of its side faces, in an arrangement which leaves an intermediate "land" on that side face between each adjacent pair of grooves and an outer "land" on that side face, the two outer grooves being unequally spaced from their respective adjacent edge faces. The expression "sub-frame" is used herein to describe any frame for fitting into an opening in a wall of a building around the actual window or door frame. It is to be understood that the window or door frame itself may in some instances be of quite small cross-section, in which case most of the structural strength would be provided by the sub-frame. Such a sub-frame element presents an advantage in that it is easily fitted in a variety of situations, and by virtue of the groove arrangement, it is possible to fit a metal window frame to the sub-frame element, so that there is always at least one groove underneath the metal window frame, this groove providing an effective moisture trap, to prevent the passage of moisture from the exterior to the interior of the building, through the joint between the sub-frame and the window itself. In many cases, the window frame itself will have a rib which engages with an outer edge of the sub-frame element, and this assists in providing a moisture trap, but unless there is a mastic seal between the window frame and the sub-frame, moisture can penetrate through the joint between these two frames. However, with a sub-frame element in accordance with the present invention, even if any such mastic joint fails, there is little chance that the moisture will be able to cross the groove formed in the sub-frame element.

Preferably, there are outer "lands" on the side face of the strip between each outer groove and its adjacent edge face. It is also preferred that at least one of the grooves is undercut. If undercut grooves are employed, then these may be of T-shape in cross-section, or they may be of dovetail-shape cross-section. In a preferred form of the invention, a structural element has plain rectangular shaped grooves in one side face, and dovetail cross-section grooves in the opposite face.

For some purposes, it is preferred to produce a sub-frame element, in which both side faces of the strip are similarly grooved.

According to a preferred feature of the invention, the width of the grooves at their mouths, the width of the intermediate "land" and the overall width of the element are all whole number multiples of a modular dimension. Preferably also, the overall depth of the element is a whole number multiple of the modular dimension. The significance of this feature of the invention is that it is possible to produce various inter-relationships between the sub-frame element and a window frame element secured on it as will hereinafter appear.

Preferably, the sub-frame element is of hollow construction, and it may be formed as an extrusion in plastics material.

According to another aspect of this invention, a composite sub-frame structural element for use in building construction comprises a strip element in accordance with the first aspect of the invention, and a rebate forming strip element of substantially constant cross-section throughout its length fitted into one of the grooves in the strip element and formed with an edge which, when the rebate forming element is fitted into the strip element, provides an edge wall upstanding from the grooved side face of the strip element and parallel with but laterally spaced from one of the edge faces of the strip element. Such a composite sub-frame structural element can have a metal window frame element fitted to it, with the window frame element located on the grooved side face of the sub-frame element, and against the edge wall provided by the rebate forming element. Hence, even if the window frame element does not itself have a flange for location against an edge wall of the sub-frame element, it is possible to provide for lateral location of the window frame element against the rebate forming element. Furthermore, since there are at least two grooves formed in the side face of the sub-frame structural element, into each of which the rebate forming element can be fitted, it will be appreciated that the lateral location of the edge wall can be varied, because the rebate forming strip element can be fitted into any one of the grooves.

The lateral location of the window frame element relatively to the sub-frame element can be rendered even more versatile, by suitable construction of the rebate forming element. For example, one form of rebate forming element may have an upstanding edge wall which when that element is fitted into a groove of the strip element, is coincident with one of the edges of the groove into which the rebate forming element is fitted. Alternatively, a rebate forming strip may be so shaped that when fitted into the strip element, its upstanding edge wall is spaced from one of the edges of the groove into which the rebate forming strip is fitted by a distance which is a whole number multiple of the modular dimension. Since the rebate forming strips can be manufactured in such a way that they can be orientated in two ways into each of the grooves, it is possible by using say two such rebate forming strips, to provide for a whole range of lateral positions of the upstanding edge wall.

A rebate forming strip may itself be formed with a condensation groove in its top face, and such rebate forming strips may be made as extrusions in plastics material, or they could be made as metal extrusions.

According to another aspect of the invention, a composite sub-frame structural element for use in building construction comprises a sub-frame strip element in accordance with the first aspect of the invention, but formed with grooves in both its side faces, and at least one wall tie anchored in one of the grooves of the strip element and projecting laterally from the face of that element in which it is anchored. Preferably there are two wall ties one anchored in each of the outermost grooves in one side face of the strip element, and each tie being so shaped that when anchored to the strip element, it projects outwardly as well as laterally with respect to the strip element. This arrangement enables the sub-frame strip element to be secured to the wall in which the sub-frame is fitted, during the construction of that wall.

Sometimes however, it is required to fit the sub-frame into an existing wall, in which either the wall is solid (i.e. there is no cavity) or in which the cavity has been closed by traditional methods which usually employ bricks extending across the open end of the cavity. In that case, it is not possible to employ wall ties, or anything else which enters the cavity. According to a preferred feature of the invention therefore, which is particularly useful in connection with an existing cavity wall a composite sub-frame structural element comprises a strip element in accordance with the first aspect of the invention, but formed with grooves in both side faces and a plate-like tie element having an anchorage formation which is secured in one of the grooves in one face of the strip element, the shape of the tie element being such that when in position on the strip element, it forms a lateral extension to one side of the strip element substantially aligned with the side face of the strip element in which it is anchored. With this construction, it is possible to lay the strip element against the end of the wall, with the tie element also lying against that end, and then to use suitable fixing means, such as screws, driven through the tie element into plugs fitted in the end of the wall.

According to yet another aspect of the invention, a composite sub-frame structural element comprises a strip element in accordance with the first aspect of the invention, but formed with grooves in both its side faces and a strip-like cavity element of substantially constant cross-section throughout its length, the cavity element having a body formed along one side with a mounting formation engaging in a groove or grooves in one side face of the strip element to secure the cavity element to that face of the strip element and also formed with at least one undercut recess on each of its edge faces whereby it is adapted to receive wall ties or mortar squeezed out from between the courses of a wall at any position along its length, whereby the structural element can be secured to a wall. A composite element of this kind, can only be used with a cavity wall, and fitted during the construction of the cavity wall. However, it provides a very firm method of securing the sub-frame strip element to the end of the cavity wall, and incidentally the cavity element itself can be used to provide a damp-course between the two leaves of the cavity wall at the end of the cavity. In fact, such a cavity element can function in the manner described in the Specifications of United Kingdom Patent Nos. 1,302,694; 1,302,695 and 1,302,696. A moisture trap formation may be formed in an outer side face of the cavity element.

According to another aspect of the invention, a composite sub-frame assembly for use in building construction comprises two strip elements each constructed in accordance with the first aspect of the invention, arranged at right angles to each other, with the end of one abutting a grooved side face of the other, and a right angled corner element fitted into aligned grooves of the two strip elements, the corner element being received in the said aligned grooves so that it does not project from the grooved faces of the two strip elements. Such an assembly enables one of the sub-frame strip elements to form a vertical component of a frame (i.e. a jamb or mullion) and the other, to form a horizontal component (i.e. a head, sill or transom). The fact that the corner element does not project from the grooves of the two strip elements into which it is fitted, means that it does not interfere with the fitting of a metal window frame into the sub-frame.

According to yet another aspect of the invention, a structural assembly comprises a sub-frame structural element in accordance with the first aspect of the invention, and a metal window frame element so that there is at least one groove of the sub-frame element under the flange of the window frame element. It will be appreciated, that it is the groove under the flange of the window frame element, which provides the moisture trap previously mentioned.

Preferably the metal window frame element has a web and a flange, the flange engaging with one edge face of the sub-frame element the web being supported on the or one of the intermediate "lands" or on the outer "land" remote from that edge face of the sub-frame element which receives the flange.

According to another aspect of the invention, a structural assembly forming a mullion or transom for use in a window comprises a sub-frame element in accordance with the first aspect of the invention, and two metal window frame elements secured to respective side faces of the sub-frame element, with the web of each metal frame element supported on the "lands" on the side of the sub-frame element appertaining to that metal frame element, whereby there is at least one groove of the sub-frame element on the underside of the web of each metal frame element.

Preferably each of the metal window frame elements has a web and a flange, the flanges engaging with one of the edge faces of the sub-frame element and the webs being supported on the or one of the intermediate "lands" or on the outer "lands" remote from the edge face of the sub-frame element which receives the flanges.

The invention also includes structural assemblies, in which sub-frame elements, composite sub-frame elements, and structural assemblies as previously described, are secured to walls by any of the fastening means which have been previously mentioned.

A sub-frame structural element, various ancilliary elements, composite structures embodying the structural element and one or more of the ancilliary elements, and various structural assemblies making use of the sub-frame structural element and the composite structure, will now be described, by way of examples of the invention, with reference to the accompanying drawings, in which.

Figure 2:
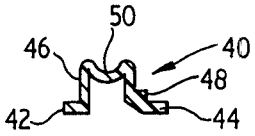
FIG. 2 is a cross-section through a first rebate forming element.
Figure 3:
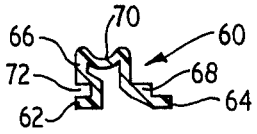
FIG. 3 is a cross-section through a second rebate forming element.
Figure 5:
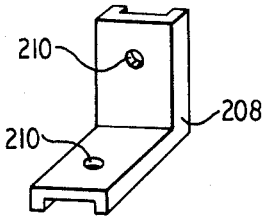
FIG. 5 is a perspective view of a corner piece.
Figure 21:
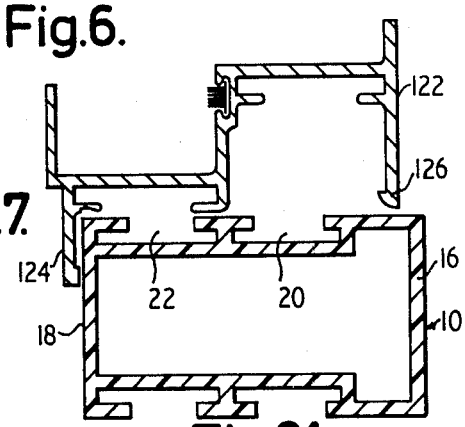
Figure 13:
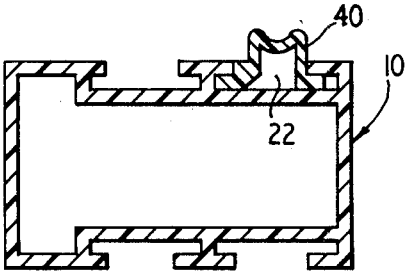
Figure 14:
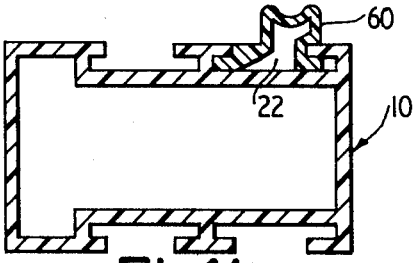
Figure 15:
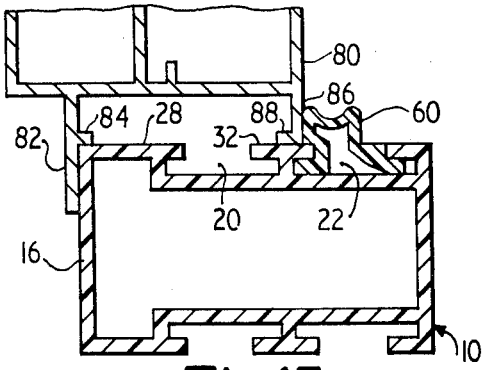
Figure 22:
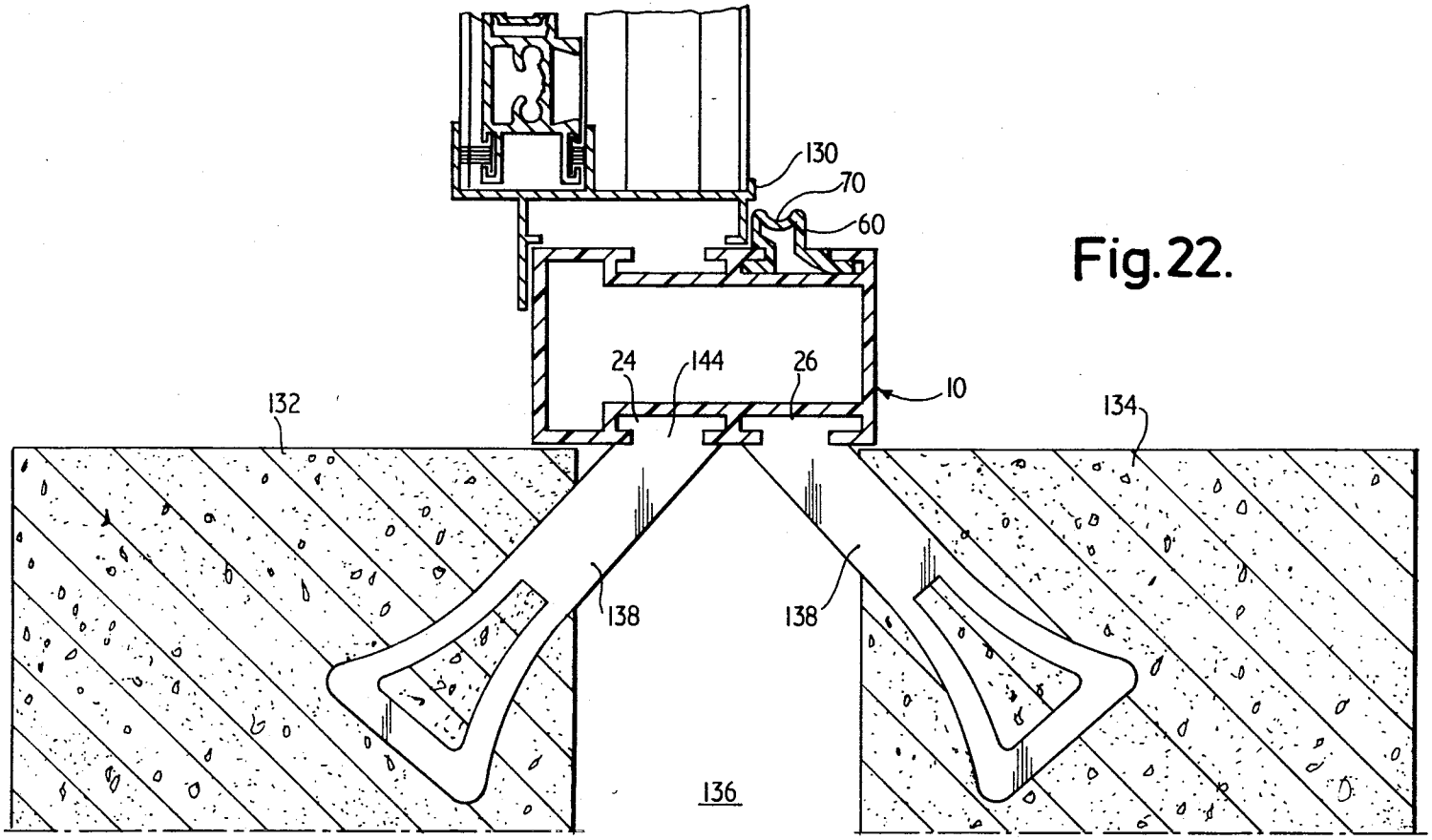
Figure 23:
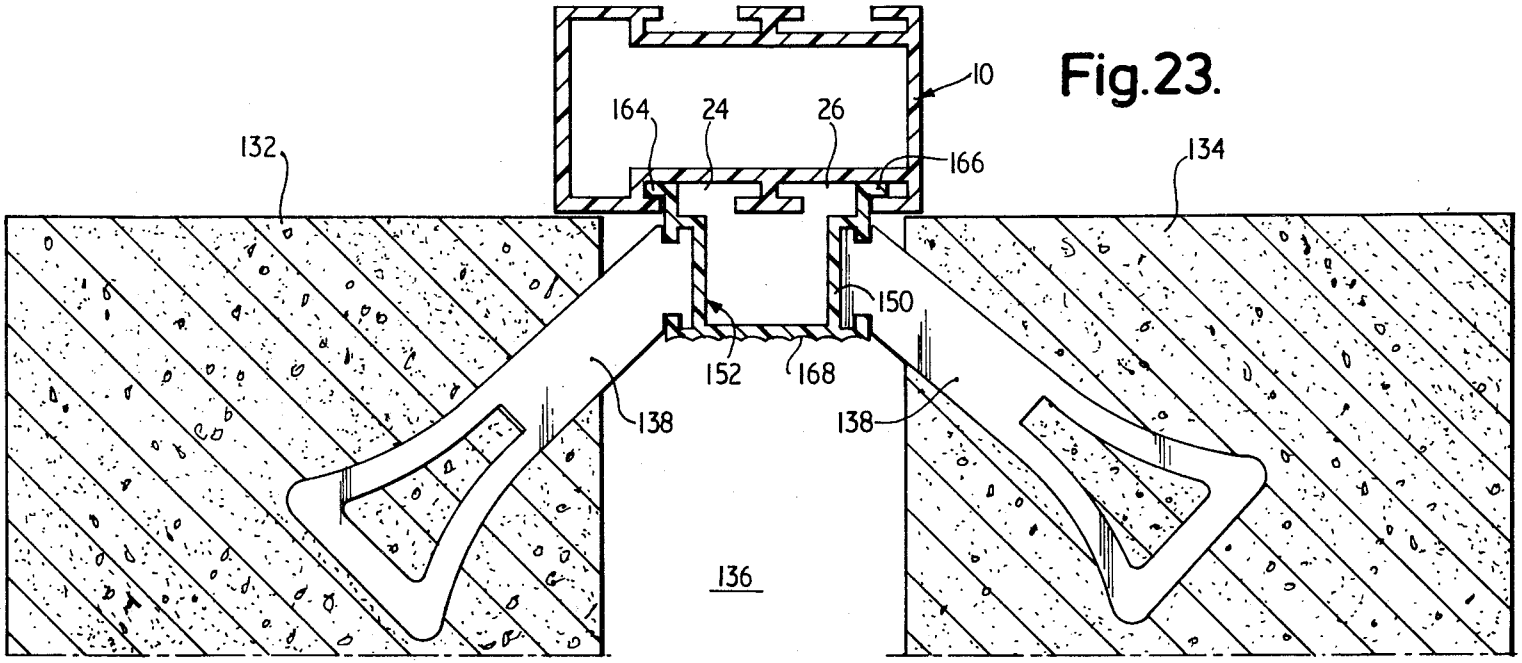
Figure 24:
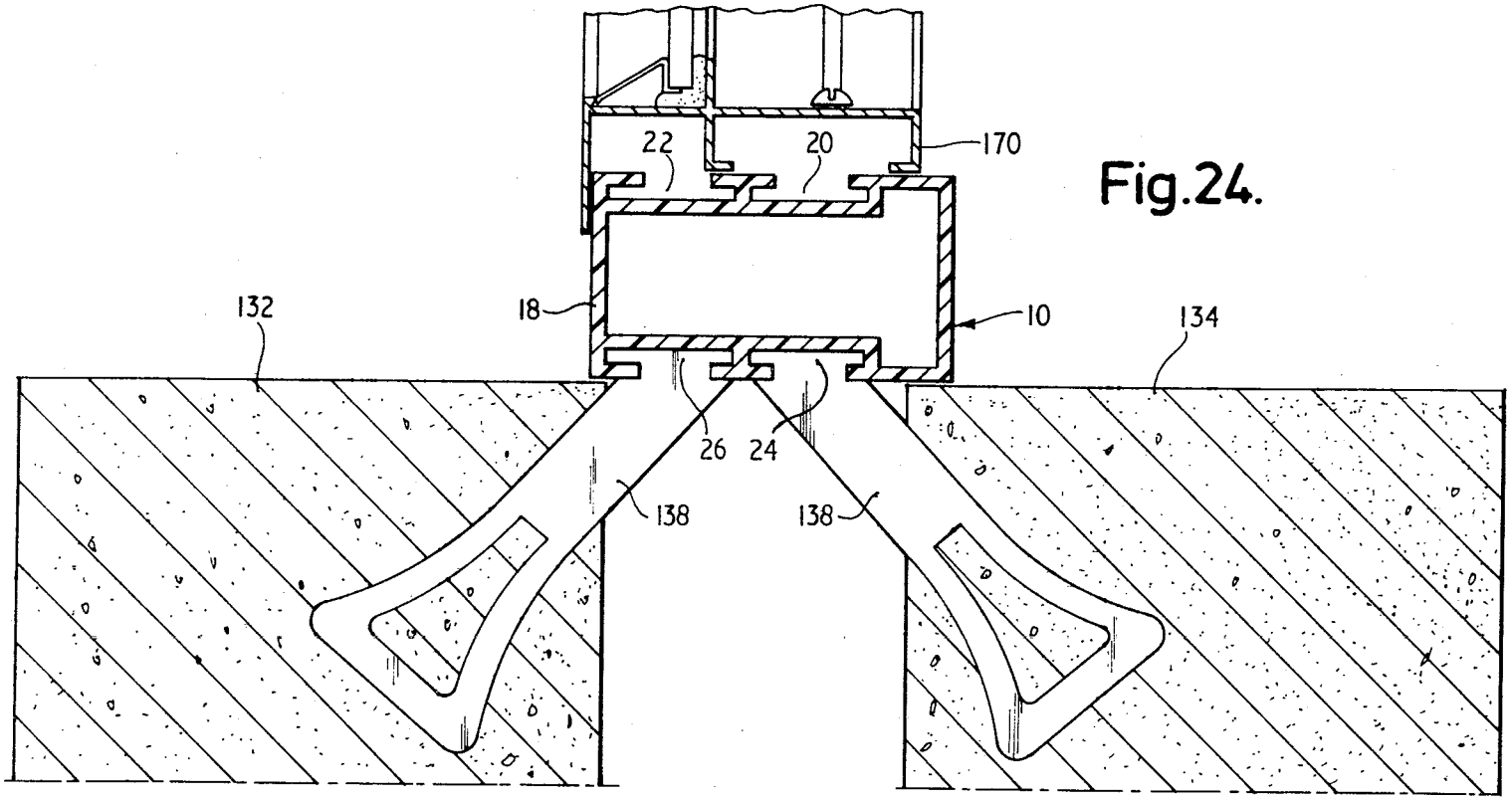
Figure 25:
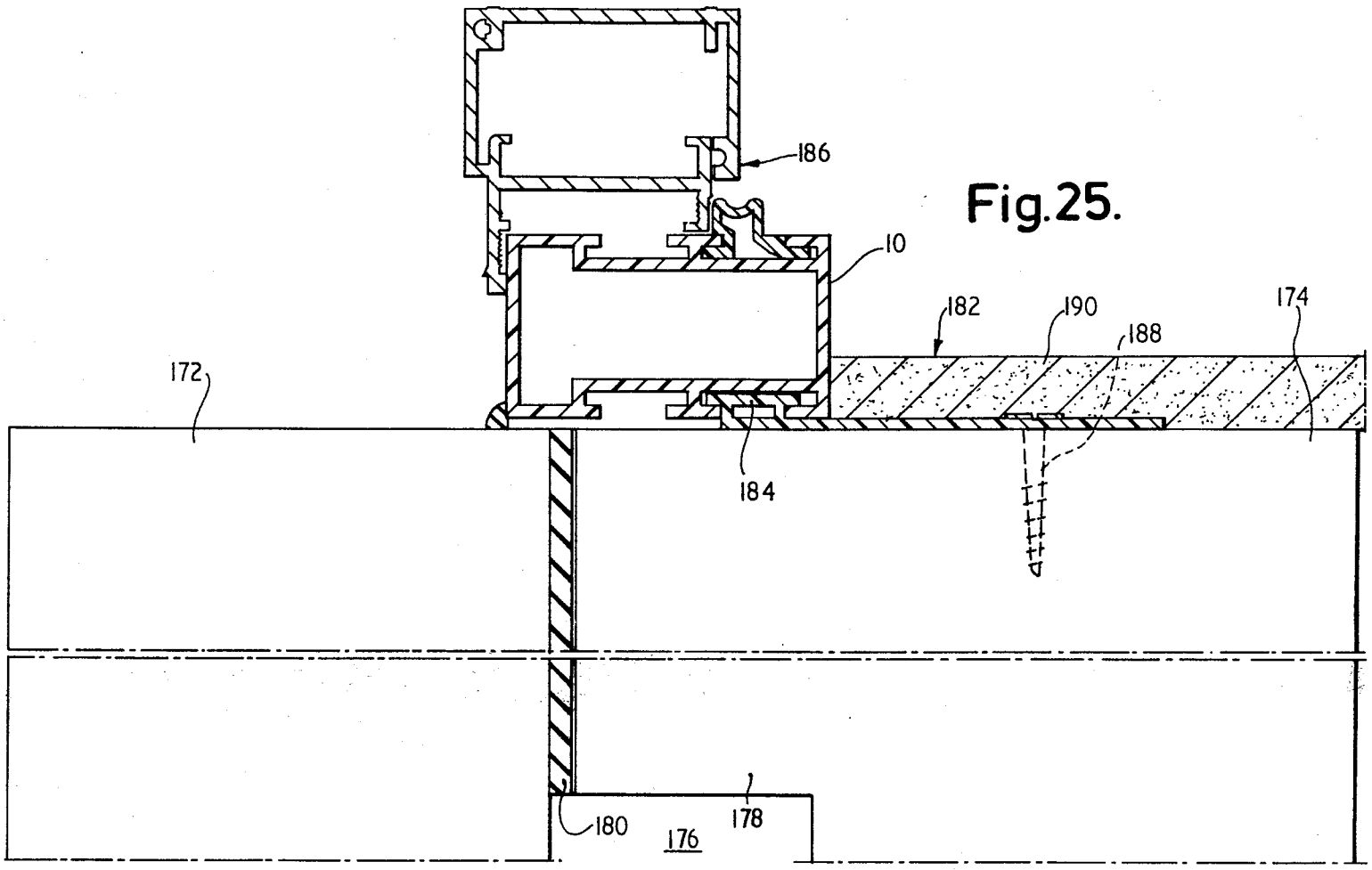
Figure 26:
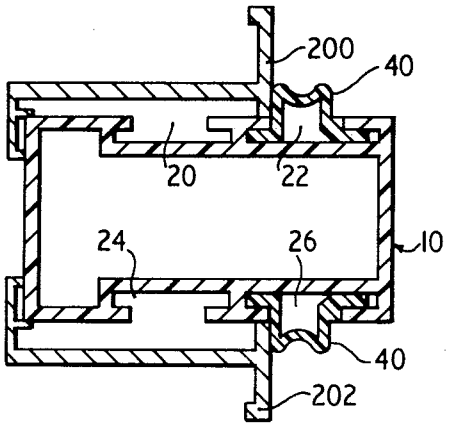
Figure 29:
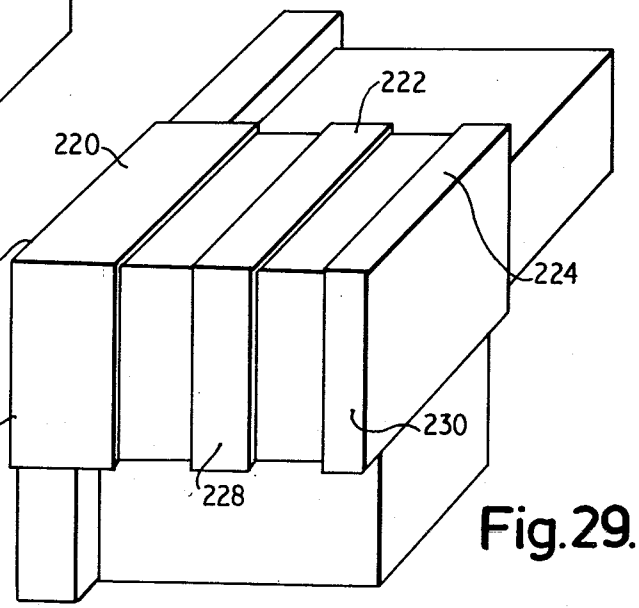
Figure 28:
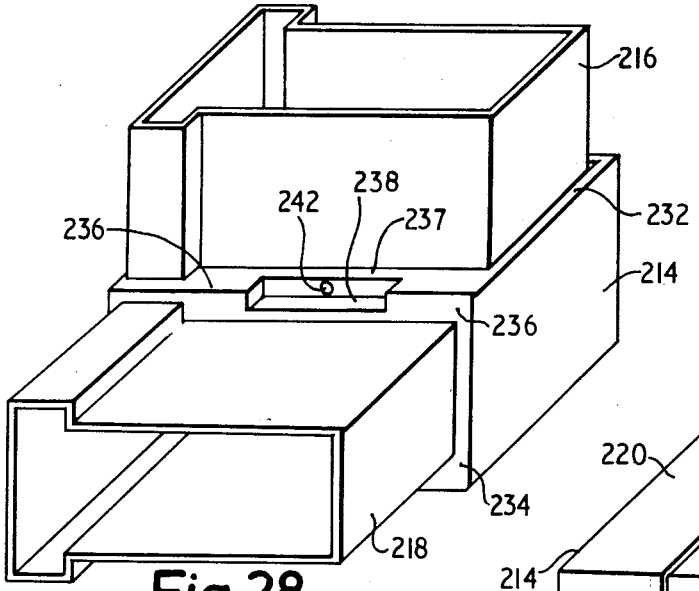
Figure 27:
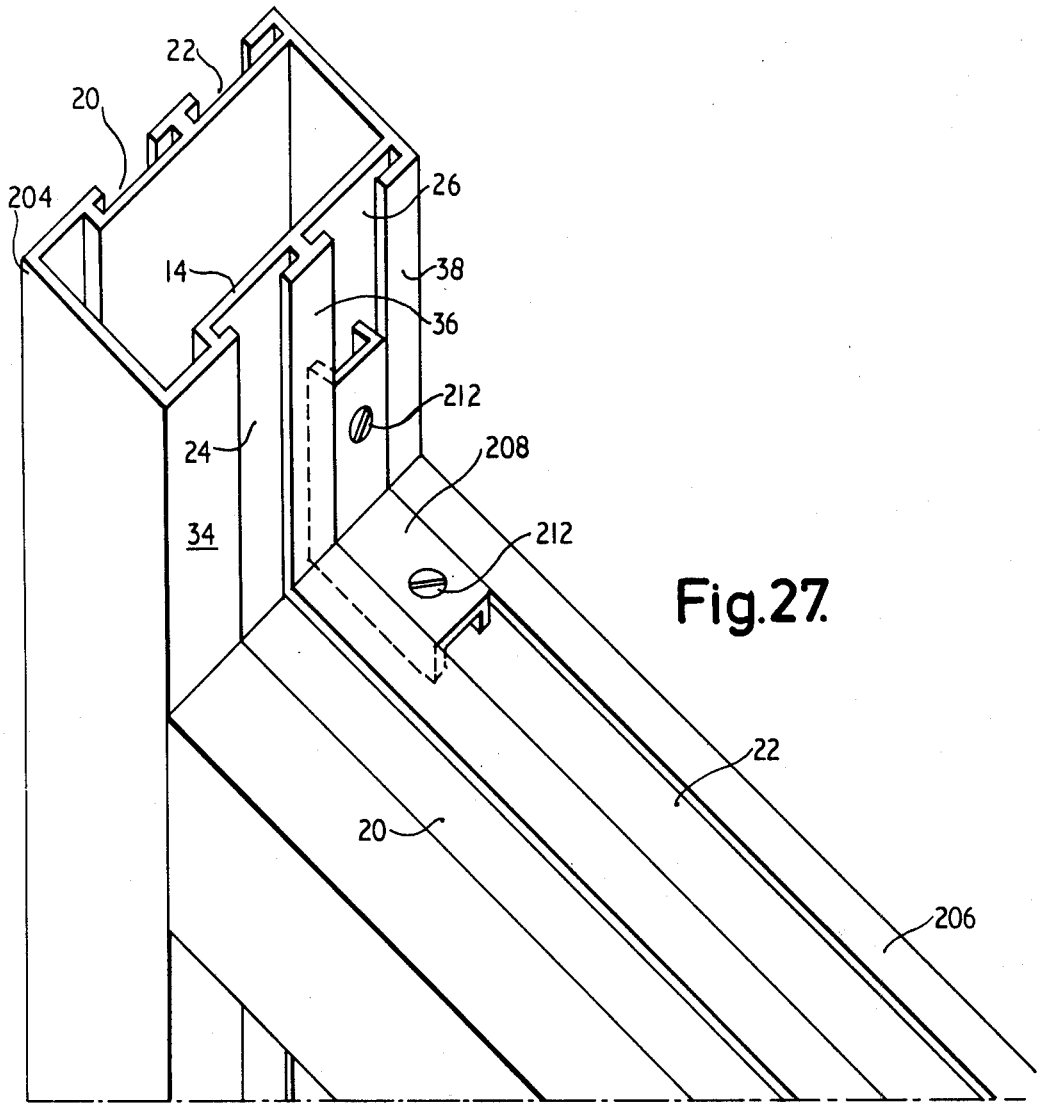
Figure 30:
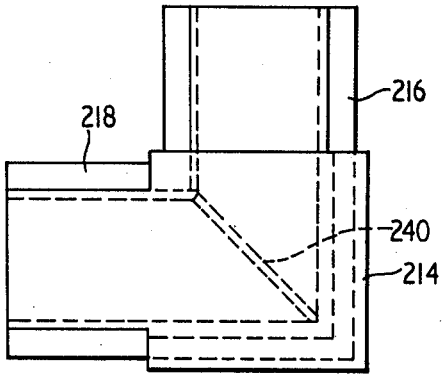
Figure 31:
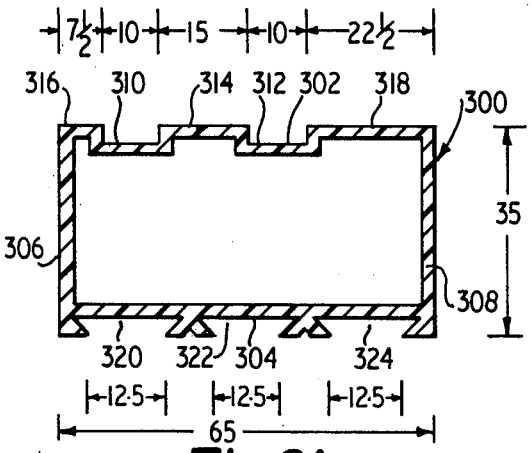
Figure 32:
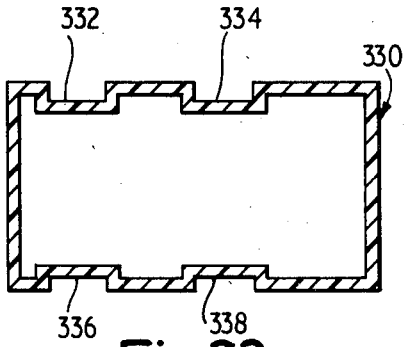

FIGS. 7 to 14 are sectional views of composite sub-frame elements using the rebate forming elements shown in FIGS. 2 and 3, FIG. 15 is a section through an assembly comprising a composite sub-frame element including a rebate forming element with a window frame fitted, FIGS. 16 to 21 are views similar to FIG. 15, but showing various window frames fitted to the sub-frame structural element without the use of a rebate forming element, FIG. 22 is a section through an assembly comprising part of a cavity wall with a sub-frame and window frame fitted in it, FIG. 23 is a view similar to FIG. 22, but showing use of the cavity element shown in FIG. 5, FIG. 24 is a view similar to FIG. 22, but showing a wide window frame, FIG. 25 is a view similar to FIG. 22, but showing the window frame fitted in an existing closed cavity wall, FIG. 26 is a cross-section through a transom or mullion employing a sub-frame structural element, FIG. 27 is a perspective view of a joint between a jamb and a transom, FIG. 28 is a perspective view of a corner piece as seen from the inside, FIG. 29 is a perspective view of the corner piece shown in FIG. 27 from the outside, FIG. 30 is a side elevation of the corner piece shown in FIGS. 27 and 28, FIG. 31 is a cross-section through an alternative form of sub-frame structural element, and FIG. 32 is a cross-section through a sub-frame structural element intended to be used to form transoms and mullions for use with frames produced from the element shown in FIG. 31.

Figure 1:
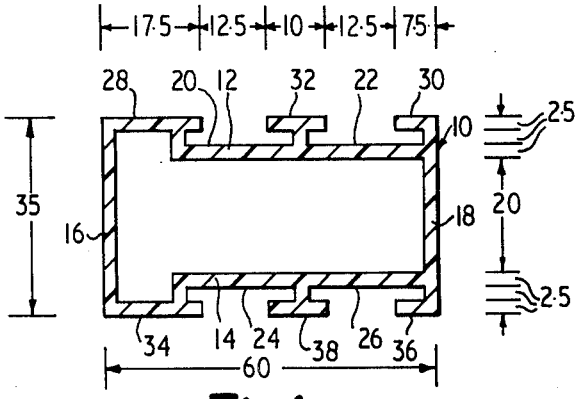
FIG. 1 is a cross-section through a sub-frame structural element.

A sub-frame structural element 10 which is shown in FIG. 1, forms the basic unit of the invention, and as will hereinafter appear, is of great versatility. The structural element 10 is formed as an extrusion in unplasticised u.p.v.c., so that it can be manufactured in long lengths, from which shorter lengths can be cut as required, in order to build up sub-frame assemblies. Whilst such sub-frame assemblies will probably be manufactured by the window frame manufacturer and possibly even fitted to the window frames themselves before delivery to a building site, it is one of the advantages of the invention, that it is possible to supply long lengths of the structural element 10 to the building site, for these to be cut up and fitted on site.

It will be appreciated, that FIG. 1 only illustrates a cross-section through the element, but because of its method of manufacture, it is of constant cross-section throughout its length, and therefore it is unnecessary to show any other views. It will be observed, that generally the element 10 is in the form of a rectangle, and certain dimensions have been indicated in FIG. 1, as these form a significant feature of the invention. All the dimensions are quoted in millimeters.

The strip 10 is of hollow construction, and has opposite side walls 12 and 14, and opposite edge walls 16 and 18, all these walls having a constant thickness of 2.5 millimeters. A pair of T-shaped grooves 20 and 22 is formed in the top side wall 12, and a corresponding pair of T-shaped grooves 24 and 26 is formed in the bottom side wall 14. This arrangement of grooves in the top and bottom side walls leaves effective outer "lands" 28 and 30 and an intermediate "land" 32 which together form the top surface of the element 10, and corresponding outer "lands" 34 and 36 and intermediate "land" 38 which together form the bottom face of the element 10. The edge faces formed on the edge walls 16 and 18 are plain. It is to be noted, that whereas the outer "land" 28 has a width of 17.5 millimeters, the intermediate "land" 32 has a width of 10 millimeters, and the outer "land" 30 has a width of 7.5 millimeters. It is particularly significant that the two outer lands 28 and 30 are of different widths, but it will be noted that all the dimensions are whole number multiples of the modular dimension which in this instance is 2.5 millimeters. The mouth of each groove 20 and 22 is 12.5 millimeters wide. The bottom side of the element is a mirror image of the top side, and hence the widths of the "land" 34, 38 and 36 correspond to those of the "lands" 28, 32 and 30 respectively.

Turning now to FIG. 2, there is illustrated one form of rebate forming strip 40, which is also formed as an extrusion in u.p.v.c. or flexible p.v.c. (although it is to be understood that this strip could be formed in metal for example aluminium). Since the rebate forming strip 40 is made as an extrusion, it has a constant cross-section throughout its length, and only the cross-section is shown in FIG. 2.

Essentially, the strip 40 comprises a pair of lips 42 and 44 extending outwardly in opposite directions from an upstanding inverted U-shaped body 46. The arrangement of the lips 42 and 44 is such that they are a fit within the recesses formed by the undercutting of any one of the grooves 20, 22, 24 and 26 in the sub-frame element 10. Also, a shoulder portion 48 is provided in the angle between the lip 44 and that side of the body portion 46, and the overall width of the body portion 46 plus the shoulder piece 48 is equal to the width of the "mouth" of any one of the grooves 20, 22, 24 and 26. Hence, it is possible to fit the rebate forming strip 40 into any one of the four grooves in the sub-frame 10, and it is also possible to orientate the strip 40 in either of two positions relatively to the groove in which it is located, so that the shoulder piece 48 is either at the front side or the rear side of the groove.

The top wall of the upstanding body 46 of the strip 40 is dished in cross-section as indicated at 50, to provide a moisture groove in the finished sub-frame.

FIG. 3 illustrates an alternative form of rebate forming strip 60, which again has lips 62 and 64 and an upstanding body portion 66 corresponding to the lips 42 and 44 and the body portion 46 in the strip 40. Also, there is a shoulder piece 68 in the angle between the lip 64 and the body 66, and the top wall of the body 66 is dished at 70 to provide a moisture groove. However, in the construction illustrated in FIG. 3, it will be observed that the outer edge of the lip 62 is in alignment with the corresponding edge wall of the body 66, and there is a groove 72 within which one of the lips formed by the undercutting of the grooves 20, 22, 24 and 26 can be received. As a result of the formation of the groove 72, it is necessary for the shoulder piece 68 to be wider than the shoulder piece 48, so that the distance between the bottom of the groove 72 and the outer edge of the shoulder piece 68 is equal to the width of the "mouth" of any one of the grooves 20, 22, 24 and 26 in the sub-frame element 10.

Figure 7:
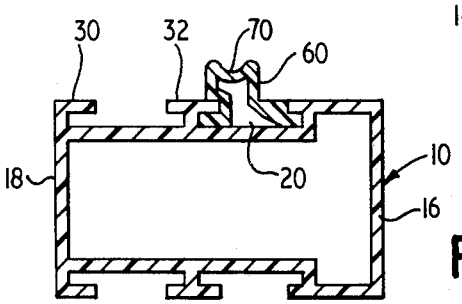

FIG. 7 illustrates how the sub-frame element 10 can be adapted to receive a window frame element (not shown) having an overall width of 30 millimeters from a flange, which engages against the front wall 18 of the element 10 to a rear wall of the window frame element. A rebate forming strip 60 is fitted into the top inner groove 20 of the sub-frame element 10, with the groove 72 facing towards the front, so that the front wall of the element 60 is positioned 2.5 millimeters forwardly from the rear edge of the intermediate "land" 32. This reduces the effective width of the "land" 32 available for the reception of the window frame element, to 7.5 millimeters. Hence, the total effective width of the element 10 which is available for the reception of the window frame element, is that provided by the front "land" 30 (7.5 millimeters) the mouth of the slot 22 (12.5 millimeters) and the available width of the "land" 32 (7.5 millimeters) giving a total of 27.5 millimeters. In addition, the flange of the window frame element will hang over the front of the sub-frame element 10, and as this flange and its bed joint is 2.5 millimeters thick, it will be seen that the total width of the window frame element is accommodated in front of the rebate wall provided by the upstanding portion of the rebate forming element 60. In addition, a moisture groove 70 is provided on the inside of the window frame element when the latter is in position.

Figure 8:
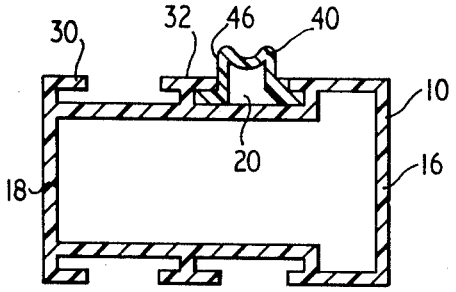

FIG. 8 illustrates an arrangement which can be used, if the overall width of the window frame element which is to be located on the sub-frame element 10 is 2.5 millimeters wider than that in the FIG. 7 arrangement. In that case, the sub-frame element itself is orientated so that the wall 18 is on the outside and the wall 16 on the inside—as was the case with the arrangement shown in FIG. 7, but instead of using a rebate forming element 60, one of the rebate forming elements 40 is fitted into the top inside groove 20. The only difference from the arrangement shown in FIG. 7, is that the outer edge of the upstanding portion 46 is coincident with the rear edge of the "land" 32, and consequently the available width on top of the sub-frame element 10 for the reception of the window frame element is 30 millimeters, so that with the flange and bed of the window frame element overhanging the outside of the wall 18, the remainder of the window frame element is neatly accommodated on top of the sub-frame element 10, with its inside edge abutting the outer face of the body 46.

Figure 9:
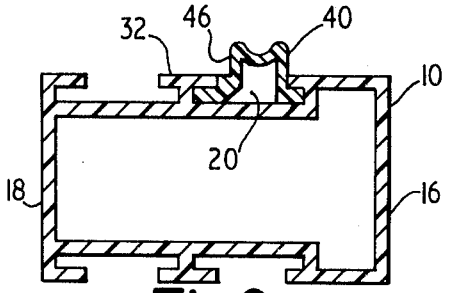

Turning now to FIG. 9, there is illustrated an arrangement for the reception of a window frame element having an overall width 2.5 millimeters wider than the window frame to be acccommodated on the arrangement shown in FIG. 8. In this arrangement, the sub-frame element 10 is maintained in the same general orientation as in FIGS. 7 and 8, but a rebate forming element 40 is fitted in the top inner grooe 20, in the reverse orientation to that illustrated in FIG. 8. In other words, the shoulder piece 48 is on the outside rather than on the inside, and this steps back the outer edge of the body portion 46 from the outside face of the sub-frame element 10 by a further 2.5 millimeters.

Figure 10:
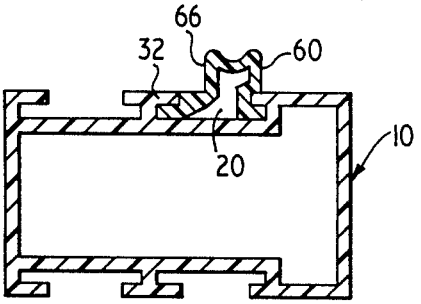

FIG. 10 illustrates an arrangement, in which the sub-frame 10 is still maintained in the same general orientation, but provision is made for accepting a window frame element 2.5 millimeters wider than that to be accommodated on the FIG. 9 arrangement. For this purpose, a rebate forming strip 60 is used, and it is fitted in the top inner groove 20 of the element 10, but orientated in the opposite direction to the FIG. 7 arrangement. In other words, the shoulder piece 68 is now on the outside, and consequently the outer edge of the body 66 is displaced 5 millimeters to the inside of the "land" 32.

In all the arrangements illustrated in FIGS. 7 to 10, the sub-frame element 10 has been orientated in the same sense. However, if it is necessary to accommodate a wider window frame element then it is necessary to adopt the orientation of the sub-frame element illustrated in FIG. 11, in which the wall 16 is on the outside, and the wall 18 on the inside. This in fact coincides with the arrangement of the strip described with reference to FIG. 1. A rebate forming strip 60 is then fitted in the top inner groove 22 of the sub-frame element 10, and since the available width of the "land" 32 is thereby reduced to 7.5 millimeters, the total available width for the reception of the window frame element is equal to that of the "land" 28 (17.5 millimeters) the mouth of the groove 20 (12.5 millimeters) and the effective portion of the "land" 32 (7.5 millimeters) making a total of 37.5 millimeters.

Figure 11:
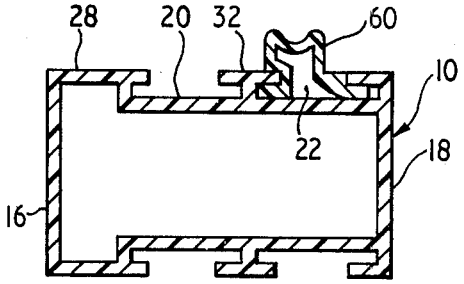
Figure 12:
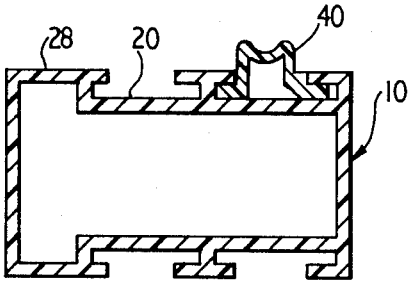

FIG. 12 illustrates another arrangement in which the sub-frame element 10 is orientated in the same general sense as shown in FIG. 11, but a rebate forming element 40 is fitted in the top inner groove 22, thus providing an effective window frame reception width of 40 millimeters in front of the outwardly facing wall of the element 40. FIG. 13 illustrates another arrangement, in which the sub-frame element 10 has the same general orientation as shown in FIG. 11, but a rebate forming element 40 is fitted in the top inner groove 22 in the opposite orientation to that illustrated in FIG. 12. Similarly, FIG. 14 shows an arrangement in which the sub-frame element 10 has the same general orientation as shown in FIG. 11, but a rebate forming element 60 is fitted in the top inner groove 22 in the opposite orientation to that illustrated in FIG. 11.

FIG. 15 illustrates an assembly in which a sub-frame structural element 10 is fitted with a rebate forming element 60 arranged in the manner illustrated in FIG. 11, and a window frame element 80 which is made of metal such as aluminium, is fitted on to the sub-frame element 10. The window frame element 80 has a depending flange 82 formed with an inwardly directed lip 84, and this flange is located against the outer face of the wall 16 of the sub-frame element 10. The lip 84 is used to locate the window frame element 80 on the top outer edge of the sub-frame 10. The window frame element also has an inner leg 86 which is shorter than the flange 82 but parallel therewith, and formed with an outturned foot 88. The wall 86 engages against the outer face of the rebate forming strip 60, and the foot 88 rests on top of the "land" 32. (In this particular example, it is to be noted that the window frame 80 projects outwardly beyond the flange 82. Throughout the specification, where reference is made to an overall width of the window frame element, this is a reference to the part of the window frame which engages with the sub-frame, that is to say the flange 82 and the wall 86 in the example illustrated in FIG. 15. It is the dimensions of this portion of the window frame which are significant in relation to the sub-frame constructions.) In practice, when the window frame element 80 is fitted on to the sub-frame element 10, mastic bedding will probably be employed between the flange 82 and the outer wall 16 in order to provide as far as possible a water-tight joint between the window frame and the sub-frame. However, it may not be possible to produce a completely effective moisture-tight barrier at this point, and one of the problems which has arisen in the use of plastics sub-frame elements, is that of forming a permanent moisture seal between the sub-frame and the window frame due to different expansion rates of the plastics and metal frames. However, it will be noted that with the construction illustrated in FIG. 15, there is a groove 20 in the sub-frame element 10, beneath the window frame element 80. Any moisture travelling between the rib 82 and the front wall 16, will then have to travel over the "land" 28, and will then encounter the groove 20. The latter will provide a very effective moisture barrier, and it is almost inconceivable, that moisture will be able to travel across the groove 20 on to the intermediate "land" 32. In other words, the groove 20 located under the window frame element 80 provides an effective moisture trap to prevent moisture penetrating between the window frame and the sub-frame. In addition there is a condensation groove provided by the rebate forming element 60 on the inside of the window.

By reference to FIGS. 7 to 14, it will be observed that whatever width of window frame is fitted to the sub-frame element 10, there will always be a groove 20 or 22 positioned beneath the window frame element, and providing the moisture trap which has just been described. Also, whichever of the rebate forming elements 40 and 60 is employed, there will still be a moisture groove positioned closely adjacent to the inside face of the window frame itself.

In the foregoing description of the arrangement shown in FIG. 15, it has been assumed that the sub-frame element 10 forms a sill member of the sub-frame, positioned beneath the window frame element 80. However, it will be appreciated that the sub-frame element 10 could equally be the head of the sub-frame positioned on top of the window frame or one of the jambs positioned against the end walls of the window frame. In other words, a simple rectangular sub-frame can be constructed from four sub-frame elements 10 arranged around the outside edges of a window frame. The manner in which corner joints are formed between the sub-frame structural elements 10, will be hereinafter described.

Figure 16:
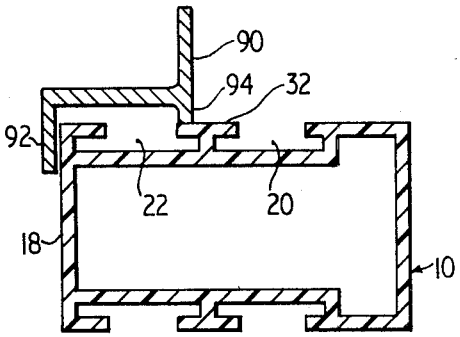
Figure 17:
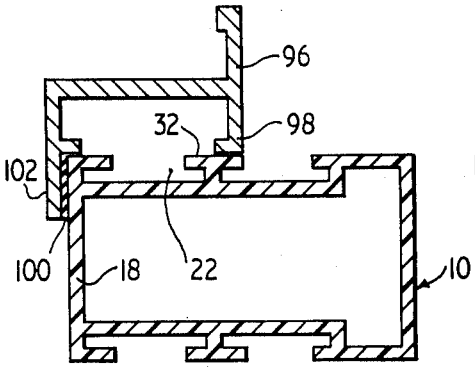

It will be appreciated, that it is not essential for the window frame element to have a flange which can be located against the outer edge of the sub-frame element. In general, metal window frames are formed with such flanges, but if no such flange were provided, it would be possible to mount the window frame element entirely on the top side of the sub-frame element 10, locating it by engagement with the upstanding face on the rebate forming element 40 or 60. However, as illustrated in FIGS. 16 to 21, it is not essential to use rebate forming elements, providing that the window frame element itself has a depending flange for engagement with the outer face of the sub-frame. Referring for example to FIG. 16, there is shown an arrangement in which the sub-frame element 10 is orientated as shown in FIG. 7, that is to say with the edge wall 18 at the outside. A metal window frame element 90 having a depending flange 92 and a short inner foot 94 is fitted on the outside of the element 10. The flange 92 locates against the outer edge face of the element 10, and the foot 94 just rests on the front of the "land" 32. It is unnecessary to provide any further lateral location for the window frame element 90, but as with the arrangement illustrated in FIG. 15, it is to be noted that there is a moisture barrier provided by the groove 22 beneath even a window frame element having an overall width of only 25 millimeters. Also the exposed groove 20 provides a condensation channel on say the inside of the window. FIG. 17 illustrates an arrangement in which a window frame element 96 is fitted to a sub-frame element 10 having the same general orientation as shown in FIG. 16. In this arrangement, a foot 98 rests on the rear part of the "land" 32, but in this case, a mastic bed 100 is shown between a flange 102 formed on the window frame element 96, and the outer edge wall 18 of the sub-frame element 10. Now it will be appreciated, that window frame elements having any intermediate width between 25 millimeters and 35 millimeters can be accommodated with the sub-frame arranged as shown in FIGS. 16 and 17, because in any case, the foot on the inside of the window frame element will always rest on the "land" 32, and hence there will always be a moisture trap provided by the groove 22 between the window frame and the sub-frame, and a condensation channel on the inside of the window frame.

Figure 18:
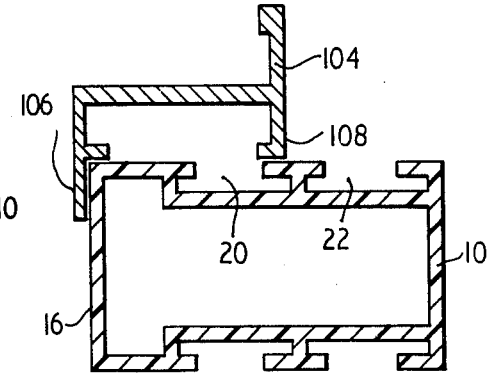
Figure 19:
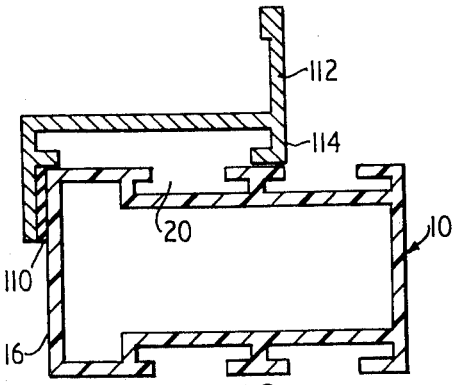

FIG. 18 shows another arrangement in which a wider window frame 104 can be accommodated on a sub-frame 10. In this case, it is necessary to arrange the sub-frame 10 in the opposite sense, so that the edge wall 16 is at the outside. With this arrangement, a foot 108 of the window frame element 104 rests on the intermediate "land" 32, so that there is a moisture trap provided by the groove 20 between the window frame and the sub-frame. FIG. 19 illustrates the fact that assuming there is a mastic bed 110, it is possible with the sub-frame 10 orientated with the wall 16 on the outside, to receive a window frame element 112 having an overall width of 45 millimeters, and for a foot 114 on that element to still rest on the intermediate "land" 32 of the sub-frame element 10. Again, even with a window frame element of this width, there is a moisture trap provided by the groove 20 between the window frame and the sub-frame. Obviously, it is possible to locate window frames having widths between 35 millimeters and 45 millimeters on the sub-frame 10 in the orientation illustrated in FIGS. 18 and 19, whilst maintaining the presence of a moisture trap provided by the groove 20, and an exposed condensation channel provided by the groove 22.

With any of the arrangements shown in FIGS. 16, 17, 18 and 19, it will be appreciated that the top inner groove of the sub-frame element 10 is exposed on the inside of the window frame itself. It would be possible to provide a filling strip to be fitted into this inner groove, for the purpose of providing a smooth flat-topped surface on the inside of the window frame itself, but generally speaking it is unnecessary to fill the top inner groove. This is because the groove can be regarded as a moisture groove such as are frequently provided on the insides of window frames.

Figure 20:
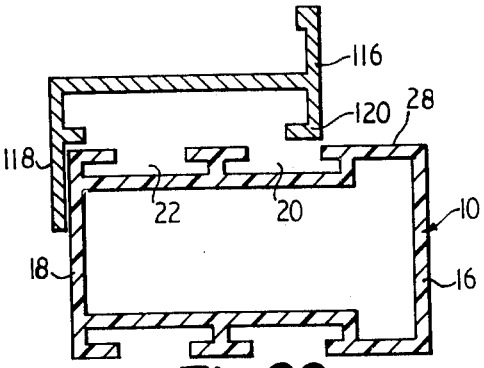

Turning now to FIG. 20, there is illustrated an arrangement in which a metal window frame 116 is positioned on a sub-frame 10 orientated as shown in FIG. 16, that is to say with the edge wall 18 on the outside. The window frame element 116 has a depending flange 118 for engagement with the outer face of the sub-frame element 10, and a foot 120 at its inner side. The foot 120 only just rests on the corner of the then top inner "land" 28, and by virtue of this, both the grooves 20 and 22 are positioned beneath the window frame element 116. This provides a double moisture trap between the window frame and the sub-frame. However, it has the slight disadvantage, that no special condensation groove is then available on the inside of the window frame. FIG. 21 illustrates another arrangement, in which the sub-frame 10 is orientated as in FIG. 20 but a window frame 122 is fitted having an overall width between a flange 124 and a foot 126 of 60 millimeters. Even this window frame can be accepted by the sub-frame 10, and the foot 126 is then positioned near to the inside edge of the sub-frame, both the grooves 20 and 22 being available to provide moisture traps between the window frame 122 and the sub-frame 10.

Whilst the sub-frame is trapped between the window frame and the end of a cavity wall at the opening for the window frame, it will be appreciated that in most instances, it is desirable if not essential, that the sub-frame element 10 shall be secured to the wall itself. The manner in which this can be done is illustrated in FIG. 22, in which for example purposes only, the arrangement of the sub-frame is similar to that illustrated in FIG. 11, that is to say a metal window frame 130 having an overall width of 40 millimeters is fitted to the sub-frame, one of the rebate forming strips 60 being employed to provide an inner location for the window frame and a moisture groove 70. However, it is to be understood that the method of securing the sub-frame 10 to the cavity wall which is to be described, can be applied with any of the possible arrangements of a window frame on the sub-frame.

Figure 6:
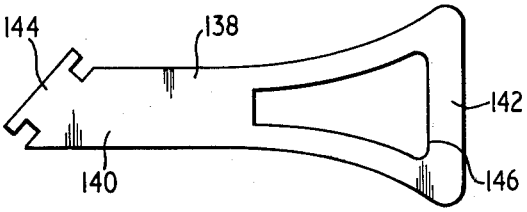
FIG. 6 is a plan view of a wall tie.

In this particular arrangement, the cavity wall has an outside leaf 132 and an inner leaf 134 spaced apart by a standard 50 millimeters wide cavity 136. The sub-frame element 10 is positioned so that it bridges the cavity 136, and this is an ideal position for fixing a window frame in a cavity wall. Special ties 138 are employed, one of these ties being illustrated in FIG. 6. Each tie 138 is formed as a moulding in plastics material (for example nylon) and is relatively thin, having for example an overall thickness of 2.5 millimeters. The tie has a straight central portion 140, a fan-shaped outer portion 142 and an anchorage formation 144 at its inner end. The fan-shaped outer portion 142 is intended to fit into a mortar joint between adjacent building blocks or bricks, and a hole 146 following the general outline of the fan-shaped portion is formed through that portion of the tie bar 138. The hole 146 saves material in the formation of the tie bar, and also provides a space into which mortar can flow for more effectively securing the tie bar in the leaf of the wall. The formation 144 has a cross-section similar to that of one of the grooves 20, 22, 24 and 26 in the sub-frame element 10, but is angled at 45° to the central body portion 140 of the tie bar 138.

As illustrated in FIG. 22, one of the tie bars 138 can be fitted with its anchorage formation 144 engaged in the bottom outer groove 24 of the sub-frame element 10, and owing to the angled arrangement of the formation 144, the tie bar 138 then depends from the underside of the sub-frame 10, and extends laterally outwards from the sub-frame. Similarly, a tie bar 138 can be fitted into the bottom inner groove 26 of the sub-frame element 10, and it also extends downwardly and outwardly, but its outward extension is opposite to that of the first tie bar. Hence, it is possible for the outer fan-shaped ends of the tie bars to be located in the outer and inner leaves respectively of the cavity wall.

During the construction of the cavity wall, when mortar has been applied to the end of a brick, one of the tie bars 138 can be fitted and this is easily done, by inserting the formation 144 through the mouth of the slot in the sub-frame at an angle to the length of the sub-frame, and then twisting the tie until it is disposed at 90° to the length of the sub-frame, so that its formation 144 just fills the groove in which it has been inserted. The tie is then moved along the groove, until its fan-shaped end becomes embedded in the mortar. It is then possible to lay the next brick and of course the tie becomes firmly anchored in the joint. Since there are ties 138 extending into both leaves of the wall, the sub-frame element 10 is very firmly secured to the end of the cavity wall, and provides an effective cavity closer so that it is not necessary to take any special steps to close the end of the cavity. The grooves 24 and 26 on the underside of the element 10 provide moisture traps preventing moisture travelling across the cavity. Moreover, since the grooves 24 and 26 extend through the length of the sub-frame element 10, it is possible to locate ties at any position along the length of that element. This is particularly advantageous where the inner and outer leaves of the wall are made of blocks of different sizes, so that the courses in the two leaves do not fall opposite each other.

The arrangement illustrated in FIG. 22 is particularly applicable where the element 10 forms a jamb of the sub-frame, but could also be used in some instances, where the element 10 is being used as a sill of the sub-frame.

Figure 4:
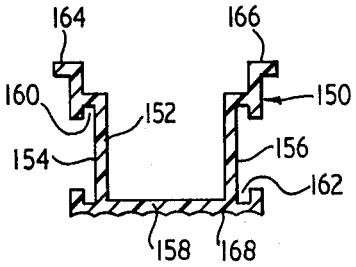
FIG. 4 is a cross-section through a cavity element.

In some conditions, it may be desirable to secure the sub-frame element 10 to the leaves of a cavity wall, by a cavity entering member such as the cavity element 150 illustrated in FIG. 4 to provide additional strength to the wall in the region of the window opening. Again, the cavity element 150 is formed as a plastics extrusion in u.p.v.c., and consequently is of constant cross-sectional shape throughout its length. Only the cross-section is illustrated in FIG. 4.

The cavity element has a substantially U-shaped body 152, with side walls 154 and 156 and an end wall 158. T-shaped grooves 160 and 162 are formed respectively in the side walls 154 and 156, and these grooves are of the same cross-sectional dimensions as the grooves 20, 22, 24 and 26 formed in the sub-frame structural element 10. Consequently, it is possible to fit the anchorage formations 144 of the wall ties 138 into the grooves 160 and 162 as required. Outwardly directed lips 164 and 166 are formed respectively on the ends of the side walls 154 and 156 remote from the end wall 158, and these lips are so arranged, that they are engageable in the recesses formed in the outside edges of the bottom grooves 24 and 26 of the sub-frame element 10, as illustrated in FIG. 23. Hence, it is possible to fit the cavity member 150 into the underside of the sub-frame element 10, where it will remain by virtue of its engagement in the grooves 24 and 26. Ties 138 can then be fitted into the grooves 160 and 162, and these ties can be built into the leaves 132 and 134 of the cavity wall, during its construction. The ties 138 are fitted into the grooves 160 and 162 in exactly the same manner as that used for fitting them into the grooves 24 and 26 as described with reference to FIG. 22 of the drawings. However, with the arrangement illustrated in FIG. 23, the body 152 of the cavity element extends into the cavity and provides a damp-proof course between the two leaves of the wall, adjacent to the window opening.

Moreover, a series of shallow grooves 168 is formed on the outside of the end wall 158, of the cavity element 150, and these provide further moisture traps preventing the passage of moisture across the cavity from the outer leaf to the inner leaf. In fact, the cavity element 150 can be made to function in a similar manner to the damp course and cavity closer devices described in United Kingdom Patent Specifications Nos. 1,302,694; 1,302,695 and 1,302,696. The cavity element could be manufactured in accordance with those patents, excepting that it has to be provided with the special formations for engagement in the grooves 24 and 26 of sub-frame element 10.

The method of securing the sub-frame element 10 to a cavity wall which is illustrated in FIG. 23 is particularly useful when the sub-frame element is a jamb, but it is to be understood that it could also be used if the sub-frame element is a sill or a head of the sub-frame. It is to be understood that sub-frame elements could be constructed as a single extrusion having the shape of the two elements 10 and 150 in combination.

FIG. 24 illustrates another method of securing the sub-frame element 10 in a cavity wall comprising inner and outer leaves 132 and 134. In this case, the sub-frame element 10 is orientated in the opposite sense to that illustrated in FIG. 22, so that the wall 18 is on the outside. Also, in the particular example illustrated in FIG. 24, no rebate forming strip is fitted, because the window frame element 170 is wide enough to extend across both the top grooves 20 and 22. However, again wall ties 138 are fitted into the bottom grooves 24 and 26, and are built into the leaves 132 and 134 of the cavity wall during the construction of that wall.

The methods of fitting the sub-frame element 10 to the cavity wall illustrated in FIGS. 22, 23 and 24, can only be used, when the sub-frame is being fitted into a new building during the construction of the building. There is however, a demand for a sub-frame which can be used in a window or door opening in an existing building. Referring now to FIG. 25, there is shown a cavity wall consisting of an outer leaf 172 and an inner leaf 174, but this is assumed to be an existing cavity wall, the end of the cavity 176 at a window opening having been closed in conventional manner by cut bricks laid endwise across the inner leaf 174, so as to extend across the cavity 176 as illustrated at 178. Also a conventional bitumen impegnated felt damp-proof course 180 is fitted between the closure constructions 178 and the outer leaf 172. Supposing now that it is required to fit a sub-frame element 10 in the window space, a special tie element 182 illustrated in FIG. 25 is used. The tie element may also be formed as a plastics moulding in nylon or as a relatively thin metal element, and only the cross-section is shown in FIG. 25. In fact, the tie member 182 may be quite narrow (similar to the ties 138) in which case members 182 will be located at spaced apart positions along the length of the sub-frame element 10. Alternatively, the tie member 182 could be formed as an extrusion, in which case, it will extend along the full length of the sub-frame element 10.

Generally, the tie member 182 is flat, but at its inner end it is formed with an anchorage formation 184 which is a fit into any one of the grooves 20, 22, 24 and 26 in the sub-frame element 10. As illustrated in FIG. 25 purely for exemplification purposes, the sub-frame element 10 is arranged as illustrated in FIG. 11, to accept a window frame element 186 having an overall width of 40 millimeters. The tie member 182 has its anchorage formation 184 fitted into the bottom groove 26, and because of this, the sub-frame element 10 will be lifted slightly, since the main portion of the tie member 182 abuts against the underside of the "land" 36 on the sub-frame element. However, the tie member 182 extends inwardly from the sub-frame element 10, and can be secured to the inner leaf 174 of the wall by any known means, such as for example screws 188 driven into plugs (not shown) fixed into the inner leaf 174 in the conventional manner. The tie members 182 will not be visible in the completed building construction, because a layer of plaster 190 is in any case applied in the reveal formed by the end of the inner leaf 174.

Because the side walls 12 and 14 of the sub-frame element 10 are mirror images of each other, it is possible to employ the sub-frame element in the construction of a mullion or transom for a window as is illustrated in FIG. 26. In that case, identical window frame elements 200 and 202 are fitted on opposite sides of the sub-frame 10. As illustrated in FIG. 26, the sub-frame element is arranged as shown in FIG. 12 of the drawings, that is to say rebate forming elements 40 are fitted into both the grooves 22 and 26, and the grooves 20 and 24 provide moisture traps for the window frame elements 200 and 202 respectively. It will be appreciated however, that a mullion or transom can be formed with any of the arrangements illustrated in FIGS. 7 to 14 and 16 to 21, and that this method of constructing a mullion or transom is not restricted to any particular type of window frame element or the employment of rebate forming elements.

An arrangement in which a sub-frame transom is connected to a sub-frame jamb, is illustrated in FIG. 27. One sub-frame element 204 (constructed as shown in FIG. 1) is arranged vertically, to provide a jamb, and the end of a horizontally arranged sub-frame element 206 (also constructed as shown in FIG. 1) abuts against an inside face of the element 204. It will be appreciated, that the end of the element 206 rests on the "lands" 34, 38 and 36 of the element 204. A special corner location piece 208 (see FIG. 5) is provided, and this simply takes the form of a moulded plastics member of angle shape, each leg of the angle being of shallow channel-shaped construction as clearly shown in FIG. 5. The overall depth of each leg of the corner piece 208 is equal to the full depth of each of the grooves 20, 22, 24 and 26, and the width of each leg is equal to the width of the mount of each of these grooves. Consequently, it is possible to press each of the legs of the corner piece 208 into one of the grooves 20, 22, 24 and 26, where it will normally remain by frictional engagement with the inner edges of the mount of that groove.

Reverting to FIG. 27, it will be seen, that the top grooves 20 and 22 of the transom member 206 align respectively with the grooves 24 and 26 of the jamb member 204, and a corner piece 208 is shown with its legs pressed respectively into the groove 26 of the jamb and the groove 22 of the transom 206. When in this position, the corner piece 208 correctly locates the jamb and transom relatively to each other in a lateral sense, and this ensures a very neat sub-frame construction, which also enables correct fitting of the metal window frame sections.

As illustrated in FIG. 5, a hole 210 is formed in each leg of the corner piece 208, and screws 212 can be passed through these holes 210 and engaged in the wall 14 of the jamb member 204 and the wall 12 of the transom member 206, for the purpose of locating the transom at the correct height relatively to the jamb. However, in some instances it may not be necessary to use screws. It will be appreciated, that the corner piece 208 could equally be fitted in the groove 24 of the jamb member 204 and the groove 20 of the transom member 206.

It has previously been mentioned, that when four sub-frame elements such as that illustrated in FIG. 1 are connected together to form a complete sub-frame, it is necessary to make special provision for the jointing of the corners. For this purpose, special corner pieces are provided, one of which is illustrated in FIGS. 28, 29 and 30. This corner piece is made as a u.p.v.c. moulding. As is apparent from the drawings, the corner piece is generally of hollow construction, the thickness of its walls being similar to that of the walls of the sub-frame element 10. Basically, the corner piece comprises a box portion 214, an upright spigot 216 and a horizontal spigot 218. FIG. 29 shows that the two outer sides of the box portion 214 are formed with grooves, which in fact are T-shaped in cross-section, and correspond in their dimensions to the grooves 20, 22, 24 and 26 in the sub-frame element 10. This leaves lands 220, 222 and 224 on one side of the box 214 and similar lands 226, 228 and 230 on the other side of the box member. Moreover, the lands 220, 222 and 224 have the same widths as the lands 28, 32 and 30 on the sub-frame element.

Each of the spigots 216 and 218 is of hollow construction, and has dimensions such that it is a push fit within a sub-frame element 10, and when fitted into the sub-frame element, provides engagement with all the inside faces of that element. Hence, it is possible to slide the lower end of a jamb member such as that shown at 204 in FIG. 27 on to the upright spigot 216, and to slide one end of a head or sill made from the structural element 10, on to the spigot 218. When the two structural elements have been located on the spigots 216 and 218, with their ends abutting against edges 232 and 234 respectively of the box member 214, a corner joint is formed, and the grooves formed in the outer walls of the box portion 214 then form continuations of the grooves in the outside walls of the sub-frame elements 10. In this manner, the outer appearance of the sub-frame is kept very neat. It will be appreciated, that plastic solvent may be applied to the spigots 216 and 218 before those spigots are pushed into the ends of the sub-frame elements, so that the corner piece becomes solvent welded to the sub-frame elements.

As illustrated in FIG. 28, the corner piece has a shoulder member 236 which forms part of the box 214, but which lies in the angle between the two spigots 216 and 218. A wide gap 238 is formed in the shoulder piece 236, and this gap is so arranged, that when sub-frame elements are fitted on to the corner piece, all four grooves 20 and 22, on both elements communicate with the space formed between the inner ends of the two parts of the shoulder member 236. A filling piece 237 of L-shape cross-section is formed in the corner of this gap, the thickness of each arm of the filler piece being equal to the thickness of the wall of the element 10. When the two sub-frame elements are fitted on to the corner piece, then the inside faces of the filler piece appear, where they are visible, as continuations of the bottoms of the grooves 20 and 22 in the two elements 10. Now it will be recalled, that the grooves in the sub-frame element can act either as moisture traps between the sub-frame and the window frame, or as condensation collecting grooves on the inside of the window frame. In either event, if the moisture collects in a vertical groove, it will run straight down that groove into the pocket formed in the corner piece, and even in the case of horizontal grooves, if there is a sufficient quantity of moisture in the grooves, it will run out at the end into the pocket in the corner piece.

As illustrated in FIG. 30, the interior of the hollow box portion 214 of the corner piece is divided by a web 240. Before the corner piece is fitted into the sub-frame elements, a hole (indicated in FIG. 28 at 242) is drilled through the inside wall of the upright spigot 216, offering a communication between the pocket formed by the shoulder member 236, and the interior of the upright spigot 216 on the top side of the web 240. Knock-out pieces may be provided in the inside walls of the spigots 216 and 218, for the purpose of forming the hole 242, but this hole should preferably only be provided in the upright spigot, and for this reason the hole is not preformed in the corner piece.

When water collects in the pocket as previously described, it will flow through the hole 242 into the interior of the corner piece 214 on the top side of the web 240. The corner piece 214 thereby becomes a collection chamber for moisture, and it may be adequate simply to allow the moisture to evaporate from that chamber. However, if it is anticipated that there will be a considerable quantity of water within the collecting chamber, then it is possible to form a hole in an outside wall of the box portion 214 of the corner piece, which will allow the water to drain out into the outer leaf of the wall in which the sub-frame is fitted, or on to an outside sill, or into a cavity, so that in any case, the water is directed away from the inside of the window frame.

The alternative form of sub-frame element which is illustrated in FIG. 31 is also made as an extrusion in rigid u.p.v.c., and consequently has a constant cross-section throughout its length. Only the cross-section is illustrated in FIG. 31. As with the sub-frame element 10, the element 300 comprises a hollow rectangular member having a top side wall 302, a bottom side wall 304, an outer edge wall 306, and an inner edge wall 308. The dimensions of the sub-frame element 300 are indicated.

However, two grooves 310 and 312 are formed in the top wall 302 of the element, but these simply comprise rectangular grooves without any undercutting. Again, this provides an intermediate "land" 314, and outer and inner "lands" 316 and 318. The widths of the grooves and lands are shown in FIG. 31, and again it is to be noted that these are in whole number multiples of the modular dimension.

With the sub-frame element 300, it is not possible to employ rebate forming strip elements as illustrated in FIGS. 2 and 3, but in practice, these will rarely be required, because the vast majority of metal window frame elements are provided with flanges for engagement with the outer edge of the sub-frame. However, the location and dimensions of the grooves 310 and 312 are such that whatever size of window frame is fitted to the sub-frame, there will always be an outer groove between the window frame and the sub-frame to provide the moisture trap as described with reference to FIGS. 7 to 21 of the drawings. In some instances of course, both the grooves 310 and 312 will be under the window frame element, providing a double moisture trap arrangement. In other instances, where one of the grooves 310 and 312 is on the inside of the window frame, it will provide a condensation groove of neat and conventional appearance.

The underside wall 304 is provided with three dovetail cross-section grooves 320, 322 and 324, these grooves being equally spaced, and having mouths 12.5 millimeters in width. The grooves 320, 322 and 324 are similar to the grooves provided on the damp-proof course members described in the Specifications of United Kingdom Patents Nos. 1,302,694; 1,302,695 and 1,304,696.

It will be appreciated that special ties can be formed similar to those illustrated in FIG. 5, excepting that the anchorage formation at the inner end must be of dovetail-shaped cross-section, for insertion in the grooves 320, 322 and 324. Again, these ties will therefore be constructed similar to the ties which are described in the aforementioned three United Kingdom Patent Specifications. It is possible therefore to place the sub-frame 300 across the end of a wall and to use tie members fitted in any of the grooves 320, 322 and 324 and built into the courses of blocks in the wall, for the purpose of securing the sub-frame element 300 to the wall. Alternatively, since mortar is squeezed out from between the courses of building blocks during the construction of the wall, and some of this mortar will engage in the grooves 320, 322 and 324, this in itself might be found adequate for securing the sub-frame element 300 to the end of the wall, without the use of special ties.

Again, it will be appreciated, that it is possible to produce a cavity element similar to that illustrated in FIG. 4, excepting that it has to be adapted to fit into the grooves 320, 322 and 324. Such a cavity element may have its outer end adapted to fit for example into the grooves 320 and 322 of the grooves 322 and 324, or it may be sufficiently wide to fit into the grooves 320 and 324. Obviously, the arrangement on the underside of the element 300 is very versatile as regards the location of a cavity element of this nature.

When the sub-frame element is lying across the end of a cavity, then the grooves 320, 322 and 324 provide additional moisture traps to prevent moisture travelling across the joint between the sub-frame and the end of the leaves of the wall.

If a sub-frame is made of elements 300, then the corner pieces should have grooves in their outside walls matching the dovetail-shaped grooves 320, 322 and 324.

It is not possible however, to use the sub-frame element 300 in the construction of a mullion or transom, because it is handed in the sense that its two side walls 302 and 304 have different grooved formations. However, for the purpose of producing mullions and transoms, a special sub-frame element 330 illustrated in FIG. 32 can be produced. This element is again a hollow rectangular plastics extrusion similar to the sub-frame element 10, and having the same outside dimensions, as the element 300. In this case, grooves 332 and 334 are formed in the top wall, identical to the grooves 310 and 312 in the element 300, but the bottom side wall of the element is a mirror of the top side wall, so that additional rectangular cross-section grooves 336 and 338 are formed in the bottom wall. It is then possible to fit two metal window frame elements to opposite sides of the sub-frame element 330 in similar fashion to the arrangement illustrated in FIG. 26 (excepting that no rebate forming members are employed) in order to produce a mullion or transom.

I claim:

1. A structural assembly comprising a sub-frame structural element and a metal window frame element, said sub-frame structural element being adapted to be fitted and secured into an opening in a wall of a building around said window frame element and said window frame element being adapted to support at least one sash frame or glazing; said sub-frame element itself comprising a strip of corrosion-resistant liquid impermeable material of substantially constant cross-section throughout its length, said cross-section providing a substantially rectangular overall shape free from protrusions, providing the strip with two side faces and two edge faces, at least two parallel longitudinally extending grooves in one side face of said strip; an intermediate land on said one side face between each adjacent pair of said at least two grooves; two outer lands located respectively between each laterally outer groove of said at least two grooves and the adjacent edge face of said strip, said two outer lands being of unequal width; said window frame element having a longitudinally extending web and a flange depending from said web, said sub-frame element and said window frame element being secured to each other with the web supported by at least said intermediate land and said flange engaging with one of said edge faces, so that there is at least one of said grooves located under said web, and at least one of said grooves uncovered on the inside of said window frame element to provide a moisture channel, the unequal widths of said two outer lands permitting either of said outer lands to be on the outside of the assembly to accommodate window frame elements of different widths.

2. A structural assembly according to claim 1, wherein said sub-frame element has a cross-section which provides at least one groove in the other of said two side faces.

3. A structural assembly according to claim 1, in which at least one of said grooves is undercut.

4. A structural assembly according to claim 2, in which at least one groove in said other side face is undercut.

5. A structural assembly according to claim 1, wherein the width of said grooves at their mouths, the width of each said intermediate land and the overall width of said sub-frame element are whole number multiples of a modular dimension.

6. A structural assembly according to claim 1, further comprising a rebate forming strip element of substantially constant cross-section throughout its length, fitted into one of said grooves in said sub-frame element, said rebate forming strip having an edge which provides an edge wall upstanding from the grooved side face of said sub-frame element and parallel with but laterally spaced from one of said two edge faces of said sub-frame element.

7. A structural assembly according to claim 2, further comprising at least one wall tie anchored in one of said at least one groove in the other of said two side faces of said sub-frame element, said wall tie projecting laterally from said other face of said sub-frame element.

8. A structural assembly according to claim 2, further comprising a plate-like tie element having an anchorage formation which is secured in one of said at least one groove in said other face of said sub-frame element, said tie element forming a lateral extension to one side of said sub-frame element substantially aligned with said other side face of said sub-frame element in which it is anchored.

9. A structural assembly according to claim 2, further comprising a strip-like cavity element of substantially constant cross-section throughout its length, said cavity element having a body formed along one side thereof with a mounting formation engaging in at least one groove in said other side face of said sub-frame element to secure said cavity element to said sub-frame element, said cavity element being also formed with at least one undercut recess in each of its edge faces whereby said cavity element is adapted to receive mortar squeezed out from between the course of a wall at any position along its length, whereby said structural assembly can be secured to a wall.

10. A structural assembly according to claim 1 further comprising means extending from the other of said two side faces of said sub-frame element for securing said sub-frame element in position in said wall of a building.

* * * * *